US008382160B2

(12) United States Patent
Disley et al.

(10) Patent No.: US 8,382,160 B2
(45) Date of Patent: Feb. 26, 2013

(54) BELT LATCH FOR A SAFETY BELT

(75) Inventors: Jonathan Disley, Kungälv (SE); Ingmar Skarin, Lindome (SE); Andreas Nilsson, Strängnäs (SE)

(73) Assignee: Volvo Car Corporation, Goeteborg (SE)

( * ) Notice: Subject to any disclaimer, the term of this patent is extended or adjusted under 35 U.S.C. 154(b) by 0 days.

(21) Appl. No.: 13/084,832

(22) Filed: Apr. 12, 2011

(65) Prior Publication Data

US 2011/0254257 A1 Oct. 20, 2011

(30) Foreign Application Priority Data

Apr. 15, 2010 (EP) ..... 10159987

(51) Int. Cl.
*B60R 22/00* (2006.01)

(52) U.S. Cl. ..... 280/808; 24/171; 24/194; 24/265 BC

(58) Field of Classification Search ..... 280/801.1, 280/806, 808
See application file for complete search history.

(56) References Cited

U.S. PATENT DOCUMENTS

| | | | | | |
|---|---|---|---|---|---|
| 3,941,419 | A * | 3/1976 | Blom | 297/475 |
| 4,291,918 | A * | 9/1981 | Finn et al. | 297/483 |
| 4,473,926 | A * | 10/1984 | Ono | 24/196 |
| 4,848,794 | A * | 7/1989 | Mader et al. | 280/801.1 |
| 4,878,272 | A * | 11/1989 | Kotikovsky et al. | 24/196 |
| 5,023,980 | A * | 6/1991 | Thomas | 24/196 |
| 5,100,176 | A * | 3/1992 | Ball et al. | 280/801.1 |
| 5,138,749 | A * | 8/1992 | McCune et al. | 24/196 |
| 7,712,194 | B2 * | 5/2010 | Fyhr | 24/171 |
| 7,963,562 | B2 * | 6/2011 | Wendt et al. | 280/806 |
| 2006/0097503 | A1 * | 5/2006 | Kiyomizu et al. | 280/801.1 |

* cited by examiner

*Primary Examiner* — Paul N Dickson
*Assistant Examiner* — Robert A Coker
(74) *Attorney, Agent, or Firm* — Brooks Kushman P.C.

(57) ABSTRACT

A belt latch including a connection plate, for connecting it to a buckle, and a latch main body rigidly connected thereto. The latch main body may have a cut-open hollow cylindrical portion housing a bending and clamping element arranged to rotate in relation thereto from a deflecting position to a clamping position if the force in an associated belt exceeds a defined force. A lid may be arranged to cover the cut-open hollow cylindrical portion.

18 Claims, 4 Drawing Sheets

A – A

A – A

BELT LATCH FOR A SAFETY BELT

CROSS-REFERENCE TO RELATED APPLICATIONS

This application claims foreign priority benefits under 35 U.S.C. §119(a)-(d) to EP 10159987.6, filed Apr. 15, 2010, which is hereby incorporated by reference in its entirety.

TECHNICAL FIELD

The present invention relates to a belt latch for a safety belt in accordance with the preamble of claim 1.

BACKGROUND

A known vehicle seat belt system is a three-point continuous loop seat belt system. A three-point continuous loop seat belt system includes a seat belt retractor and a length of belt webbing. The belt webbing extends from the retractor through a D-ring fixed to the vehicle and then down to an anchor point near the vehicle floor. A belt latch is slidable along the length of belt webbing between the D-ring and the anchor point. To use the seat belt system, a vehicle occupant grasps the belt latch and inserts it into a buckle. When the belt latch is fastened in the buckle, a portion of the belt webbing extends across the lap of the vehicle occupant and a portion of the belt webbing extends diagonally across the torso of the vehicle occupant. When the belt latch is released from the buckle, the belt webbing is wound onto the retractor.

The belt latch should slide along the belt when the occupant moves the belt latch toward the buckle. The belt latch should also slide along the belt after the occupant unlocks the belt latch from the buckle so that the retractor can fully wind up the belt. The refractor would otherwise carry the belt latch upwardly to the D-ring, whereupon further movement of the belt would be prevented as the D-ring blocked further movement of the belt latch.

However, in the event of an accident it can be advantageous to separate the lap section of the belt webbing from the breast section, i.e. to block the belt webbing in the belt latch. Thus, at the event of a vehicle collision, when the belt webbing is subject to a predetermined load the belt latch should cinch the belt webbing, that is, block movement of the belt webbing through the belt latch. This cinching action helps to restrain movement of the vehicle occupant in the event of a vehicle collision in such a way that it may eliminate the need to use an expensive and complicated pyrotechnical seat-belt tensioner.

EP1983857 discloses such a belt latch for a safety belt that has a connecting plate for connecting the belt latch to a belt buckle, a basic latch body connected rigidly to the connecting plate, and further a deflecting and clamping element with a deflecting edge and a clamping edge. The deflecting and clamping element is arranged on the basic latch body in such a manner that it executes a rotational movement about an axis of rotation in relation to the basic latch body from a first deflecting position to a second clamping position when a defined belt force is exceeded. The deflecting and clamping element has a convex outer surface. In order to be able to achieve a low weight for the belt latch and, in particular, for the deflecting and clamping element, the deflecting and clamping element is mounted on the basic latch body by means of the convex outer surface. The basic latch body has the shape of a longitudinally cut-open hollow cylinder, i.e. the shape of a groove. It exhibits a concave inner surface with a cross-section in the shape of a partial circle. The bending and clamping element is positioned on the concave inner surface of the basic latch body, which serves as sliding surface. The bending and clamping element is also formed as a groove and the radius of its outer surface corresponds to the radius of the inner surface of the basic latch body. If a defined threshold force, which the belt webbing exercises on the bending edge is exceeded, breaking noses retaining the bending and clamping element break and the belt webbing presses the bending and clamping element into the clamping position. The greater the force within the belt webbing, the greater is also the clamping force, so that the aim of decoupling between lap and upper body section of the belt webbing is achieved.

As the basic latch body of EP1983857 has the shape of a longitudinally cut-open hollow cylinder with the bending and clamping element positioned on the inner surface thereof and the bending and clamping element also formed as a groove where the radius of its outer convex surface corresponds to the radius of the concave inner surface of the basic latch body there is a risk of dirt and dust entering the functional area of the basic latch body. The presence of contaminations within the functional area of the basic latch body could potentially cause a malfunction problem, where the bending and clamping element would be prevented from properly executing its clamping function in the case of an accident. The open nature thereof also increases the risk of other objects being jammed into the functional area of the basic latch body, which could potentially interfere with the clamping abilities of the bending and clamping element.

SUMMARY

One object of the invention is to improve the belt latch of the prior art type in such a way that it exhibits improved robustness and durability.

This object is achieved by means of a belt latch having the characteristics of claim 1.

Thanks to the provision of a belt latch for a safety belt comprising a connection plate for connecting the belt latch to a buckle, a latch main body being rigidly connected to the connection plate and having a cut-open hollow cylindrical portion with a concave inner surface and an upper eye and a lower eye for receiving the belt into the cut-open hollow cylindrical portion, a bending and clamping element with a bending edge and a clamping edge and a convex outer surface is slidingly arranged on the concave inner surface of the cut-open hollow cylindrical portion via its convex outer surface to rotate around a rotation axis in relation to the latch main body from a first deflecting position to a second clamping position if the force in the belt exceeds a defined force, and which further comprises a lid arranged on the latch main body such that it covers the cut-open hollow cylindrical portion, said lid having a leading edge and a trailing edge and two opposing edge covering portions each provided with first fixing means arranged to engage corresponding second fixing means provided at two opposing side elevations terminating the concave inner surface of the cut-open hollow cylindrical portion, the leading edge of said lid being supported by said latch main body, an improved belt latch providing for decoupling between lap and upper body section of the belt webbing whilst ensuring robustness and durability is provided.

Preferred embodiments are listed in the dependent claims.

BRIEF DESCRIPTION OF THE DRAWINGS

In the following, the invention will be described in greater detail by way of example only with reference to attached drawings, in which.

Still other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

In overview, the present invention relates to an improved belt latch 1 for a seat belt system. Normally, to engage a seat belt system, the belt latch 1 is manually grasped and is pulled across the lap and torso of the occupant sitting in a vehicle seat. As the belt latch 1 is pulled across the lap and torso of the occupant, the belt latch moves along the seat belt webbing, and the seat belt webbing is unwound from the retractor. When the seat belt webbing has been pulled across the lap and torso of the occupant, the belt latch 1 is connected with a buckle, not shown. The buckle is normally connected to the vehicle body and disposed on the side of the vehicle seat opposite to an anchor point. When the seat belt system is thus buckled, the length of seat belt webbing is divided by the belt latch 1 into a torso portion which extends across the torso of the occupant and a lap portion which extends across the lap of the occupant.

The force applied to the lap portion of the seat belt webbing may be increased substantially if the vehicle decelerates suddenly and the vehicle occupant's momentum causes the occupant to move forward relative to the seat, such as during an accident. The parts of the present belt latch 1 are be configured so that, if this occurs, the seat belt webbing will be clamped in the belt latch 1.

Figure 1:
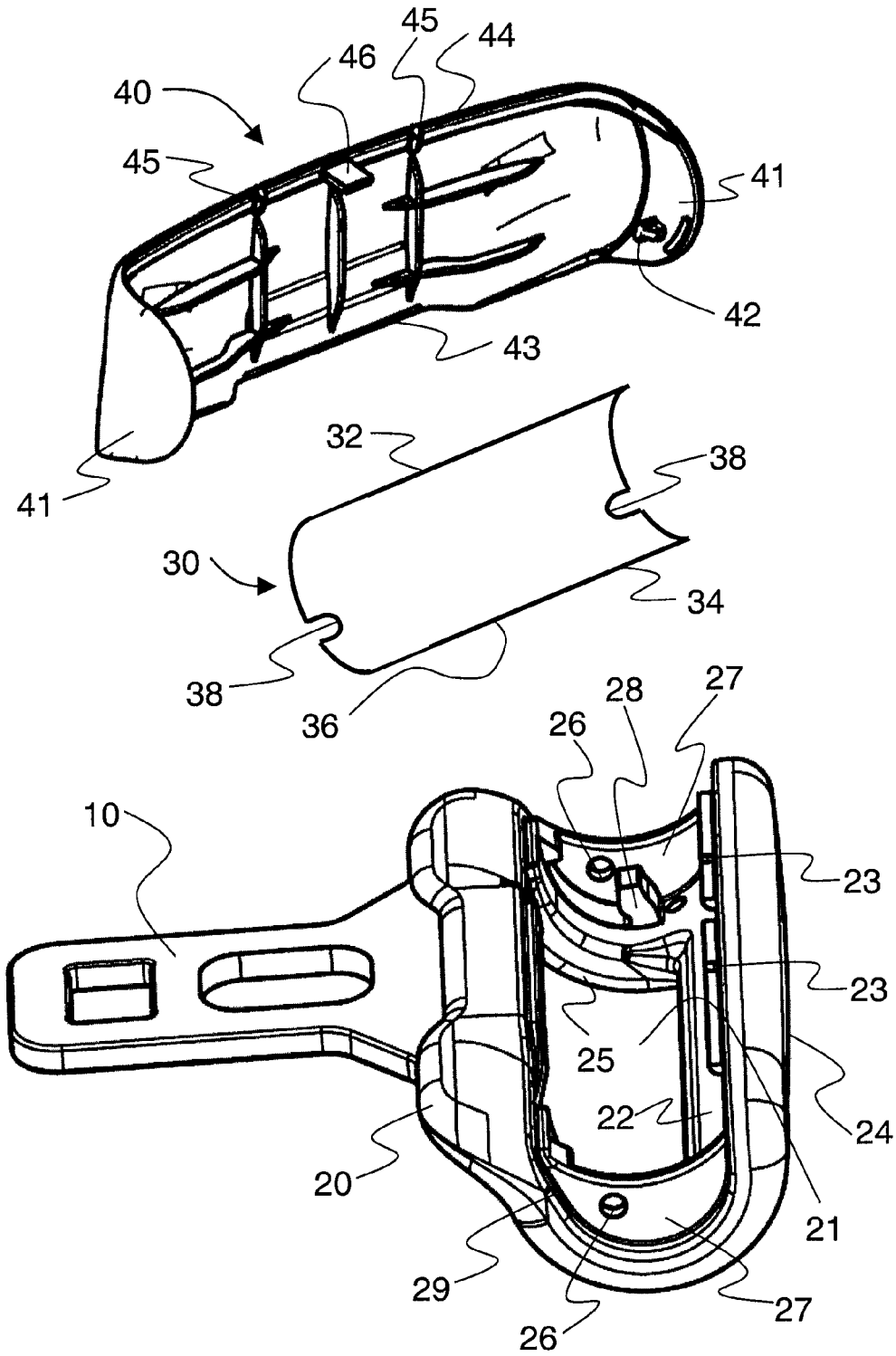
FIG. 1 is a pre-assembly view of a belt latch for a safety belt in accordance with the present invention.
Figure 2:
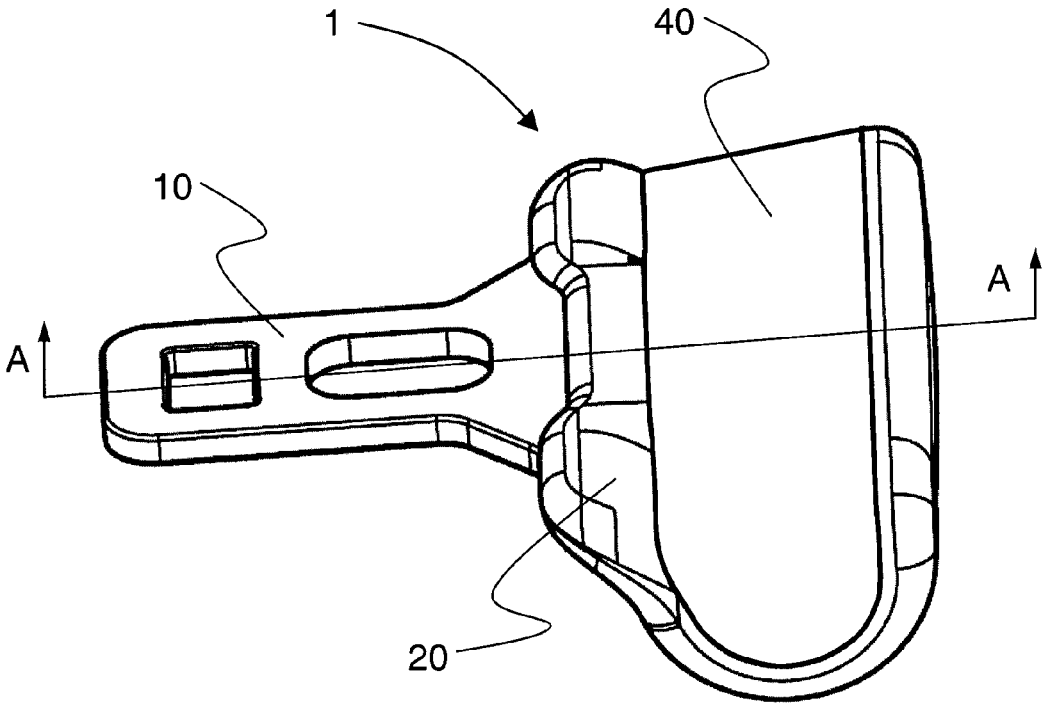
FIG. 2 is an assembled view of the belt latch according to FIG. 1.

FIG. 1 shows a pre-assembly view of a belt latch 1 for a safety belt in accordance with the present invention. FIG. 2 illustrates an assembled view of the same belt latch 1.

The belt latch 1 for a safety belt in accordance with the present invention comprises a connection plate 10 for connecting the belt latch to a buckle, not shown. A latch main body 20 is rigidly connected to the connection plate 10 and has a cut-open hollow cylindrical portion 21 with a concave inner surface 22. The latch main body 20 further has an upper eye 24 and a lower eye 25 for receiving the belt into the cut-open hollow cylindrical portion 21.

Figure 3:
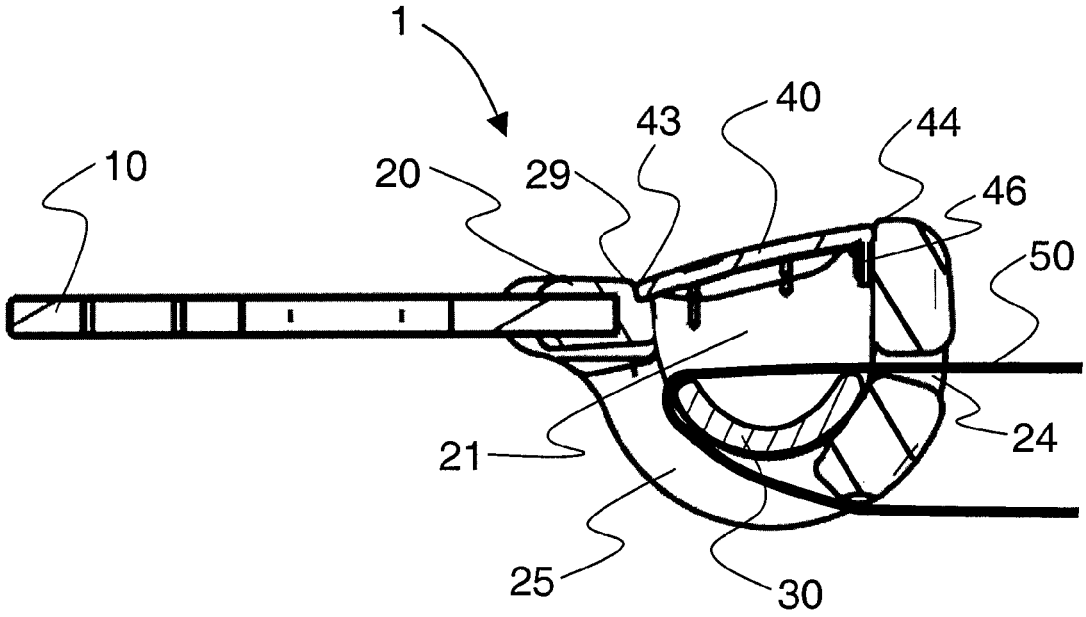
FIG. 3 is a section through the belt latch of FIG. 2 along section A-A in a first deflecting position.
Figure 4:
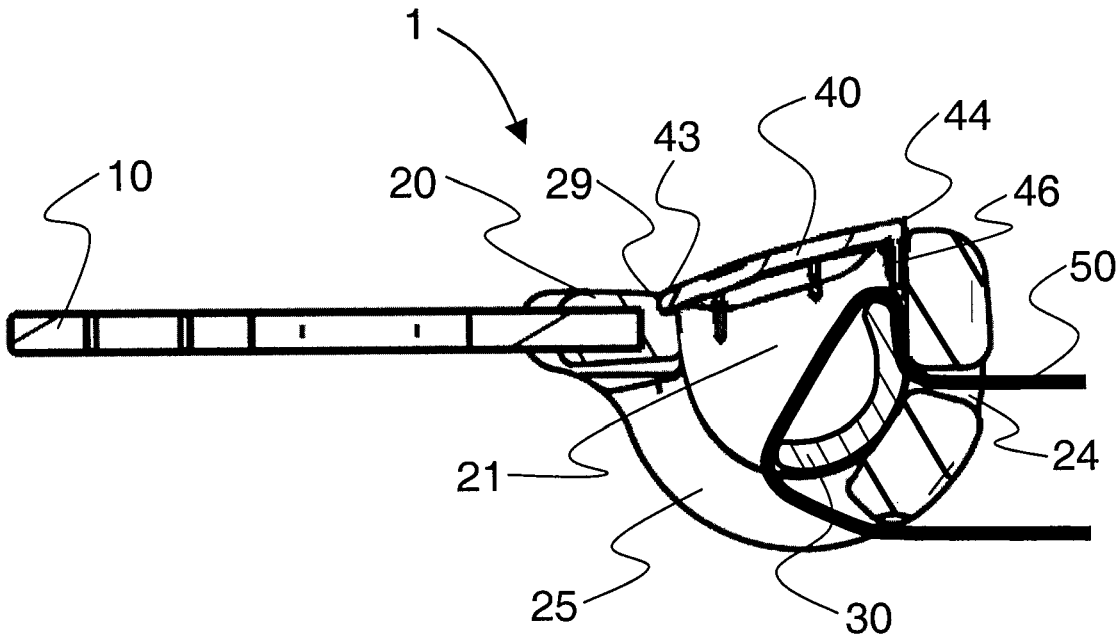
FIG. 4 is a section through the belt latch of FIG. 2 along section A-A in a second clamping position.

A bending and clamping element 30, with a bending edge 32 and a clamping edge 34 and a convex outer surface 36 is slidingly arranged on the concave inner surface 22 of the cut-open hollow cylindrical portion 21 via its convex outer surface 36 to rotate around a rotation axis in relation to the latch main body 20 from a first deflecting position, in accordance with FIG. 3, to a second clamping position, in accordance with FIG. 4, if the force in the seat belt webbing 50 exceeds a defined force.

If a defined threshold force, which the seat belt webbing 50 exercises on the bending edge 32 (this is generally of a magnitude of between 2 and 20 kN), is exceeded, cut-out sections 38 in the bending and clamping element 30 pushes on and breaks breaking noses 28 and the seat belt webbing 50 presses bending and clamping element 30 from the position shown in FIG. 3 into the position shown in FIG. 4, whereby it slides over the concave inner surface 21 of the latch main body 20.

In alternative embodiments, the breaking noses 28 may be replaced with other means for releasing the bending and clamping element 30 for rotational movement from the position shown in FIG. 3 into the position shown in FIG. 4. Such other means may e.g. comprise spring loaded retaining means (not shown), which are set to release the bending and clamping element 30 for movement as above if the defined threshold force is exceeded.

In the clamping position, as shown in FIG. 4, the seat belt webbing 50 clamps two-dimensionally between bending and clamping element 30 and an edge of upper eye 24, whereby the clamping edge 34 of the bending and clamping element 30 and the edge of the upper eye 24 are formed as clamping cheeks. The greater the force within the seat belt webbing 50, the greater is also the clamping force, at least up to a predetermined maximum value, so that the aim of decoupling between lap and upper body section of seat belt webbing 50 is achieved. It has been found that the predetermined maximum value of the clamping force should suitably be approximately 4 kN.

A lid 40 is arranged on the latch main body 20 such that it covers the cut-open hollow cylindrical portion 21. The lid 40 has a leading edge 43 and a trailing edge 44 and two opposing edge covering portions 41. Each of the two opposing edge covering portions 41 are, at the respective insides thereof, provided with first fixing means 42 arranged to engage corresponding second fixing means 26 provided at two opposing side elevations 27 terminating the concave inner surface 22 of the cut-open hollow cylindrical portion 21.

The first fixing means 42 are provided as fixing pins, which fixing pins 42 are protruding inwardly from the opposing edge covering portions 41 of the lid 40 and arranged to engage corresponding second fixing means 26, which are provided as fixing holes in the opposing side elevations 27 terminating the concave inner surface 22 of the cut-open hollow cylindrical portion 21.

The opposing side elevations 27 terminating the concave inner surface 22 of the cut-open hollow cylindrical portion 21 are preferably elastic, such that they are allowed to flex slightly to allow the fixing pins 42, which preferably have chamfered or slanted distal edges, to be snapped into connection with the fixing holes 26.

The leading edge 43 of the lid 40 is, when the lid 40 is mounted, supported by the latch main body 20.

In order to effectively protect the functional area of the belt latch 1, i.e. the cut-open hollow cylindrical portion 21, the surrounding edges of the lid 40 are recessed into a cut-out or chamfer 29, which at least partially encircles the cut-open hollow cylindrical portion 21 of the latch main body 20. In this way a the lid 40 fits tight and snuggly to the latch main body 20 such that the operation of the bending and clamping element 30 is not hampered by objects, dirt or dust whilst at the same time it is ensured that the lid 40 is not inadvertently removed from the belt latch 1.

It is preferred that the lid 40 is elastic such that lid 40 is allowed to rotate slightly around the first 42 and second fixing means 26, i.e. the fixing pins 42 are a allowed to rotate slightly in the fixing holes 26, and the trailing edge 44 of the lid 40 thus allowed to deflect outwardly of the cut-open hollow cylindrical portion 21 as the bending and clamping element 30 pushes on a protruding member 46 of the lid 40 in the second clamping position, as shown in FIG. 4.

Thus, as the bending and clamping element 30 has moved into the second clamping position, as shown in FIG. 4, the trailing edge 44 of the lid 40 will, supported by the latch main body 20 at its leading edge 43, flex outwardly of the cut-open hollow cylindrical portion 21, whilst being retained in position by the connection between the first fixing means 42 and the second fixing means 26, e.g. the fixing pins 42 and the fixing holes 26.

The lid 40 is further arranged such that as the trailing edge 44 of the lid 40 deflects outwardly of the cut-open hollow cylindrical portion 21 the lid 40 will bend slightly causing the two opposing edge covering portions 41 to pinch the opposing side elevations 27 terminating the concave inner surface 22 of the cut-open hollow cylindrical portion 21, such that the first fixing means 42 is brought into a firmer grip of the second fixing means 26. Thus ensuring that the lid 40 remains attached to the latch main body 20, even as the bending and clamping element 30 pushes thereupon.

To ensure proper guidance of the lid 40 at the cut-out hollow cylindrical portion 21, the trailing edge 44 of the lid 40 is further provided with first guiding means 45, which first guiding means 45 are arranged to engage corresponding second guiding means 23, which second guiding means are provided at the latch main body 20.

The first guiding means 45 are provided as at least one protruding element, which protruding elements 45 are arranged to engage corresponding second guiding means 23, which are provided as at least one cut-out into the latch main body 20 corresponding in shape to the shape of the first guiding means 45.

The present invention also relates to a vehicle safety belt system, which comprises a belt latch 1 as described above.

The invention is not limited to the above-described embodiments, but may be varied within the scope of the following claims.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A belt latch for a safety belt comprising:

a connection plate for connecting the belt latch to a buckle;

a latch main body being rigidly connected to the connection plate and having a cut-open hollow cylindrical portion with a concave inner surface, two side elevations disposed at opposite ends of the cut-open hollow cylindrical portion to terminate the concave inner surface, and an upper eye and a lower eye for receiving the belt into the cut-open hollow cylindrical portion;

a bending and clamping element with a bending edge and a clamping edge and a convex outer surface is slidingly arranged on the concave inner surface of the cut-open hollow cylindrical portion via its convex outer surface to rotate around a rotation axis in relation to the latch main body from a first deflecting position to a second clamping position if the force in the belt exceeds a defined force; and a lid removably attached to the latch main body such that it covers the cut-open hollow cylindrical portion;

the lid having a leading edge and a trailing edge engaging the latch main body and two opposing edge covering portions in overlapping engagement with the respective side elevations to cover the opposite ends of the cut-open hollow cylindrical portion, the edge covering portions provided with first fixing means arranged to engage corresponding second fixing means provided at the respective side elevations.

2. The belt latch according to claim 1 wherein surrounding edges of the lid are recessed into one of a cut-out and chamfer at least partially encircling the cut-open hollow cylindrical portion of the latch main body.

3. The belt latch according to claim 1 wherein the trailing edge of the lid is provided with first guiding means arranged to engage corresponding second guiding means provided at the latch main body.

4. The belt latch according to claim 3 wherein the first guiding means are provided as at least one protruding element arranged to engage corresponding second guiding means provided as at least one cut-out.

5. The belt latch according to claim 1 wherein the first fixing means are provided as fixing pins protruding from the opposing edge covering portions and arranged to engage corresponding second fixing means provided as fixing holes in the opposing side elevations.

6. The belt latch according to claim 1 wherein the lid further comprises a protruding member extending from the trailing edge and positioned such that the bending and clamping element when rotated to the second clamping position contacts the protruding member to push against the trailing edge and thereby cause the trailing edge of the lid to deflect outwardly of the cut-open hollow cylindrical portion, said outward deflection of the trailing edge causing the lid to bend such that the two opposing edge covering portions pinch inwardly on the respective opposing side elevations and urge the first fixing means into firmer engagement with the second fixing means.

7. A belt latch for a safety belt comprising:

a connection plate for connecting the belt latch to a buckle;

a latch main body connected to the connection plate, the latch main body having a cut-open hollow portion, two side elevations disposed at opposite ends of the cut-open hollow portion to terminate an inner surface thereof, and an upper eye and a lower eye for receiving the belt into the cut-open hollow portion;

a bending and clamping element configured to rotate around a rotation axis in relation to the latch main body from a first deflecting position to a second clamping position if the force in the belt exceeds a defined force; and a lid removably attached to the latch main body such that it covers the cut-open hollow portion and a portion of the belt therein, the lid having two opposing edge covering portions in overlapping engagement with the respective side elevations to cover the opposite ends of the cut-open hollow portion, the edge covering portions provided with first fixing means arranged to engage corresponding second fixing means provided at the respective side elevations.

8. The belt latch of claim 7 wherein the lid has a leading edge and a trailing edge and two opposing edge covering portions each provided with first fixing element arranged to engage corresponding second fixing element provided at two opposing side elevations of the cut-open hollow portion.

9. The belt latch of claim 8 wherein the first and second fixing elements are configured to permit the lid to rotate when the bending and clamping element rotates from the first deflecting position to the second deflecting position.

10. The belt latch of claim 9 wherein the first fixing element is a pin and the second fixing element is a hole.

11. The belt latch of claim 8 wherein the lid is sufficiently elastic such that the trailing edge of the lid is allowed to deflect outwardly of the cut-open hollow portion as the bending and clamping element pushes on the lid in the second clamping position.

12. The belt latch of claim 11 wherein the lid is arranged such that as the trailing edge of the lid deflects outwardly of the cut-open hollow portion the lid will bend slightly causing the two opposing edge covering portions to pinch the opposing side elevations of the cut-open hollow portion, such that the first fixing element is brought into a firmer grip of the second fixing element, ensuring that the lid remains attached to the latch main body, even as the bending and clamping element pushes thereupon.

13. The belt latch of claim 8 wherein the leading edge of the lid is supported by the latch main body.

14. The belt latch of claim 7 wherein surrounding edges of the lid are recessed into a cut-out that at least partially encircles the cut-open hollow portion.

15. The belt latch of claim 7 wherein the belt is slidable through the upper and lower eyes when the bending and clamping element is in the first deflecting position.

16. The belt latch of claim 7 wherein the belt is clamped within the upper and lower eyes when the bending and clamping element is in the second clamping position.

17. The belt latch of claim 7 wherein the latch main body includes a breaking nose operable with the bending and clamping element to set the defined force.

18. A belt latch for a safety belt comprising:

a connection plate for connecting the belt latch to a buckle;

a latch main body being rigidly connected to the connection plate and having a cut-open hollow cylindrical portion with a concave inner surface, two side elevations disposed at opposite ends of the cut-open hollow cylindrical portion to terminate the concave inner surface, and an upper eye and a lower eye for receiving the belt into the cut-open hollow cylindrical portion;

a bending and clamping element with a bending edge and a clamping edge and a convex outer surface is slidingly arranged on the concave inner surface of the cut-open hollow cylindrical portion via its convex outer surface to rotate around a rotation axis in relation to the latch main body from a first deflecting position to a second clamping position if the force in the belt exceeds a defined force; and a lid removably attached to the latch main body such that it covers the cut-open hollow cylindrical portion and having a leading edge and a trailing edge engaging the latch main body and two opposing edge covering portions in overlapping engagement with the respective side elevations to cover the opposite ends of the cut-open hollow cylindrical portion, the edge covering portions provided with first fixing means arranged to engage corresponding second fixing means provided at the respective side elevations, and the lid further comprising a protruding member extending from the trailing edge and positioned such that the bending and clamping element when rotated to the second clamping position contacts the protruding member to push against the trailing edge and thereby cause the trailing edge of the lid to deflect outwardly of the cut-open hollow cylindrical portion, said outward deflection of the trailing edge causing the lid to bend such that the two opposing edge covering portions pinch inwardly on the respective opposing side elevations and urge the first fixing means into firmer engagement with the second fixing means.

* * * * *